US006240850B1

(12) United States Patent
Holler

(10) Patent No.: US 6,240,850 B1
(45) Date of Patent: Jun. 5, 2001

(54) BULLETS FOR USE IN HITTING TARGETS AT SHORT RANGE

(76) Inventor: Christopher A. Holler, 2449 Via Sienna Ave., Winter Park, FL (US) 32789

( * ) Notice: Subject to any disclaimer, the term of this patent is extended or adjusted under 35 U.S.C. 154(b) by 0 days.

(21) Appl. No.: 09/332,610

(22) Filed: Jun. 14, 1999

(51) Int. Cl.[7] ..... F42B 12/34; F42B 5/26

(52) U.S. Cl. ..... 102/439; 102/464; 102/508; 102/519; 29/1.3

(58) Field of Search ..... 29/1.3, 1.31; 102/430, 102/439, 464–469, 507–510, 514–519, 501

(56) References Cited

U.S. PATENT DOCUMENTS

| | | | | |
|---|---|---|---|---|
| Re. 4,491 | * | 8/1871 | Berdan | 102/439 |
| D. 138,288 | | 7/1944 | LaClair . | |
| 634,383 | * | 10/1899 | Webley | 102/509 |
| 1,101,224 | * | 6/1914 | Wesson | 29/1.3 |
| 1,267,257 | | 5/1918 | Murray . | |
| 1,991,923 | | 2/1935 | Dhome . | |
| 2,041,253 | | 5/1936 | Leussler . | |
| 2,172,054 | * | 9/1939 | Di Brazza-Savorgnan | 102/501 |
| 2,341,310 | * | 2/1944 | Calhoun et al. | 102/430 |
| 2,397,206 | * | 3/1946 | Ryan | 29/1.3 |
| 2,402,068 | | 6/1946 | Meador . | |
| 3,209,691 | | 10/1965 | Herter . | |
| 3,830,157 | | 8/1974 | Donnard et al. . | |
| 3,987,731 | | 10/1976 | Brzuskiewicz . | |
| 4,044,685 | | 8/1977 | Avcin . | |
| 4,681,038 | | 7/1987 | Washburn . | |
| 4,742,776 | * | 5/1988 | Scuto | 102/439 |
| 4,750,427 | * | 6/1988 | Carter | 102/516 |
| 4,955,938 | * | 9/1990 | Romer et al. | 102/430 |
| 4,986,186 | | 1/1991 | LaRocca et al. . | |

(List continued on next page.)

FOREIGN PATENT DOCUMENTS

14659 * 4/1899 (GB) ..... 102/510

OTHER PUBLICATIONS

*Cartridges of the World* by Baines, 1965, p. 64, 1965.*
Ian V. Hogg, *The Cartridge Guide*, 1982, pp. 7–9 "The Mechanics of Identification".
Sabot Product News, "Nosler Bullets for Sportsmen", What's Hot: Nosler Introduces Partition–HG Hunting Sabots for Muzzleloaders; http://www.nosler.com/Sabot%20News.html.
William R. Meehan & John F. Thilenius, "Safety in Bear Country: Protective Measures and Bullet Performance at Short Range" from "Firearms in Bear Country"; http://www.outdoorq.com/misc/usdarept.htm.
Gil Sengel, *Rifle: The Sporting Firearms Journal*, "The Mysterious 12.7x70mm Schuler"; http://www.alloutdoors.com/AllOutdoors/NewStand/Rifle/Mar98/Schuler.html.

*Primary Examiner*—Harold J. Tudor
(74) *Attorney, Agent, or Firm*—Greenberg Trauriq, LLP; Anthony R. Barkume

(57) ABSTRACT

An improved bullet featuring a large, heavy non-aerodynamically shaped projectile that is to be used in short range life or death situations. This projectile and cartridge would be used in large game applications where the intent is not to fire unless in imminent danger. The projectile and cartridge combination of this invention would cause immediate destruction and transfer energy rapidly. The projectile is shaped to increase aerodynamic resistance by redirecting the displaced air into its preferred path. The large cross section and short body height further limit aerodynamic ability. The casing is machined from solid stock to provide a stronger more stable enclosure. This large diameter personal defense bullet uses a soft projectile body of high mass and improved shape, in conjunction with a high capacity casing of one piece precision machined construction to deliver maximum stopping power. A plurality of projectile bodies are presented herein which provide the stopping power required to drop a charging animal.

9 Claims, 4 Drawing Sheets

U.S. PATENT DOCUMENTS 5,063,853 11/1991 Bilgeri .
5,225,628 7/1993 Heiny .
5,277,119 1/1994 Ricco, Sr. .
5,408,931 4/1995 Tallman .
5,440,994 8/1995 Alexander .
5,463,959 11/1995 Kramer .

* cited by examiner

BULLETS FOR USE IN HITTING TARGETS AT SHORT RANGE

BACKGROUND OF THE INVENTION

The present invention relates to bullets, and in particular to bullets that can be effectively used to drop a target such as a large animal at a relatively short distance.

Diameter, weight, shape, propellant capacity, length and material are all parameters which determine the effective range, accuracy and stopping power of bullets. Based on these features, specific characteristics of flight, penetration depth, internal destruction, and exit properties can be controlled by modifying several or all of these parameters.

The projectile parameters define the inflight and impact characteristics of the projectile. The casing or cartridge provides the means to carry the charge that ultimately supplies the force necessary to propel the projectile to and into its intended target. The casing design also specifies the method of loading and unloading the cartridge from the firearm.

Projectile and casing designs have become very specific to meet the various needs of hunters, military, police, and personal defense market segments. Hunters may choose among these characteristics in order to select a bullet that fits their hunting approach.

In large game applications, specific designs have been fabricated to drop animals from a safe distance, usually above 100 yards to as far as 2000 yards, where an animal would not hear, see, or smell the hunter. To achieve this goal, increases in range and accuracy have been achieved by using smaller aerodynamically shaped projectiles having deformable characteristics on impact with the target. A small projectile with a small cross section has less frontal exposure to frictional forces. In addition, aerodynamic features, such as a pointed tip, smooth exterior and tapered body sections help to further reduce drag and maintain the inflight directional stability of the projectile. The casings used with these aerodynamic projectiles typically utilize banded, necked down or restricted openings. This forces the expanding gas through a smaller opening thereby increasing the velocity of the projectile and effectively increasing the range.

The characteristics that increase range, power and accuracy are useful in applications where the hunter is the aggressor, where stealth and anonymity are important.

In contrast to the aforementioned characteristics found in prior art large game hunting, the intent of this invention is to provide a bullet which is used for personal defense at close range. In this framework, the hunter is now a potential victim, and the animal has become a fierce aggressor. A bullet in this scenario is used to prevent personal loss of life against imminent acts of aggression, such as might be posed from a charging rhino or lion. The desired bullet would therefore have completely different properties from the aforementioned bullets, and be used at very close range when it can be determined that the threat is unavoidable. Aerodynamic modifications, such as those utilized for long range large game hunting, would not be employed. The small size, high speed and aerodynamic properties of prior art inventions would tend to cause the projectile to rapidly pass through a target at close range, thereby not inflicting the stopping power required to remove the threat. It is also likely that the bullet may incur damage to other than the intended target, because of the bullet's potential to travel a mile or more.

Bullets used in personal defense or other close range military applications utilize a different approach to bullet design. These bullets typically employ the use of materials other than lead in the construction of the projectile. They are typically made of several large projectiles or a multitude of smaller projectiles that either break into individual components on impact, or separate immediately upon firing. The increased surface area of the individual pellets slows the projectiles on impact and reduces the likelihood of substantially injuring other than the intended target.

Materials such as plastic, latex, or rubber have been used in riot control applications where the intent is to stop the forward motion of an aggressor, while limiting physical damage. The bullet does not penetrate the target but instead transfers energy and spreads or flattens at impact, thereby supplying a force capable of limiting motion.

Frangible bullets (U.S. Pat. No. 3,911,820) are another sector of the bullet design field used in personal defense applications. Frangible bullets are made of smaller components which break apart on impact, releasing the components, which then separate and spread causing widespread internal damage. U.S. Pat. No. 5,440,994 discloses a round containing a multitude of individual pellets surrounded by fluid which are contained within a sealed enclosure. The projectile retains its shape during flight, but upon impact the individual pellets separate and rapidly transfer their energy to the target.

U.S. Pat. No. 5,225,628, HIGH IMPACT-LOW PENETRATION ROUND, discloses a round intended for close range (0–35 yards) applications. This anti-personnel shotgun round has three slugs, made of wax and lead. The slugs are arranged in one multi-part casing, made of a brass base joined with walls made of a synthetic transparent material. When fired, the shape and tumbling action of the slugs slows the projectiles, limiting their effective range while providing a high impact load.

The casings used with these bullets have a metallic base with a primer located in the center of the base. Casing walls are plastic and may be made from a sheet of material which is subsequently formed, or may be extruded, or created via a casting process. These casings are low cost and have been designed to enable, rapid manufacture using automated processes and are designed for low power applications using standard rifles or shotguns.

In order to provide the true stopping power required to halt a charging animal, a strong high capacity casing is required, having properties suitable for high pressure firing with little deformation.

The present invention relates to projectiles as used in large game hunting where a large slow projectile having non-aerodynamic form will be used to stop adversaries at very close range, maximizing immobility of target and minimizing potential danger to out of range bystanders. Aerodynamic qualities are not useful in close range applications. At close range, large size and high weight are critical factors that contribute to the stopping power of a projectile. What is desired therefore is an improved bullet and casing design, that provides the combination of characteristics necessary for close range, high impact, personal protection applications. The bullet and casing combination should provide the ability to stop or immobilize large game instantly on impact. The casing should be of high quality construction capable of working under the increased loads required to propel a large projectile. The projectile should have no aerodynamic enhancing properties and preferably should have range limiting properties to decrease the likelihood of danger to other than the intended target.

SUMMARY OF THE INVENTION

This invention presents a design of a cartridge and shell where the intent is to stop a significant foe at close or very close range. The intended use of this shell is personal defense where it is to be used in a life or death situation. The effective shooting range is between 0 and approximately 50 yards. Several bullet configurations are presented offering the combination of features to provide this functionality. The bullet features a short, fat and heavy slug made of lead, which would flatten significantly on penetration of the intended target. The shape of the bullet offers no aerodynamic enhancements. In one embodiment the projectile has a flat bottom and large round head. The casing is cylindrical, and precision machined in order to adhere to strict dimensional accuracy requirements to achieve the load rating required to propel this large heavy bullet. This invention uses extremely large caliber rounds having a height to diameter size ratio of 1 to 1 or 1.25 to 1 with a minimum diameter of 0.8 inches. A dimpled nose projectile with a flat rim and a dimpled nose projectile with a radiused rim are defined to be used in combination with the improved casing of this invention.

The projectiles described in this invention create an increased pressure area in the path of the projectile by focussing and redirecting the airflow into the path of the projectile. Upon impact these same shapes cause a similar effect on tissue by locally increasing pressure prior to tearing at the edges thereby increasing damage and destruction. Upon penetration the projectiles deform further increasing in cross-section and thereby increasing damage to the target.

Another aspect of this invention is the casing used which has been designed specifically for holding a large powder charge. This casing is a solid one piece casing machined from a block or bar where stepwise removal of material forms the casing. A casing fabricated in this manner has a high cost in comparison to rolled, extruded or cast, mass produced casings. The casing is made of substantially one piece of brass machined to the correct dimensions to allow a crimp fit around the projectile. The machining of the case from a solid block or bar stock allows strict control of the manufacturing process in order to produce a void free, high quality casing usable for repeated firing under heavy load. Superior strength is acquired by the careful removal of material to define the resulting casing. Increases in wall thickness to achieve the desired strength may therefore be easily accommodated in the manufacture of this bullet. The casing is long in comparison to the diameter and is longer than available casings where the ratio of length of casing to diameter for this bullet is 5 to 1.

DETAILED DESCRIPTION OF THE PREFERRED EMBODIMENT

Figure 1:
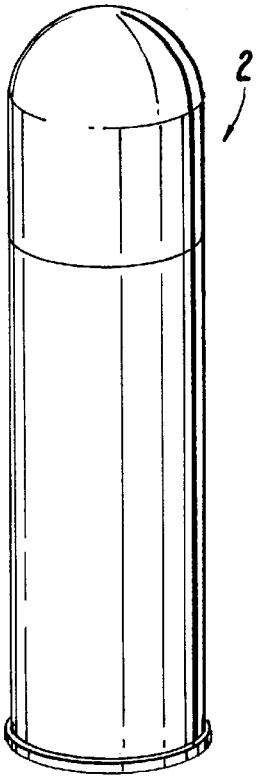
FIG. 1 is an isometric view of the preferred embodiment of the present invention with the round nose slug.
Figure 1A:
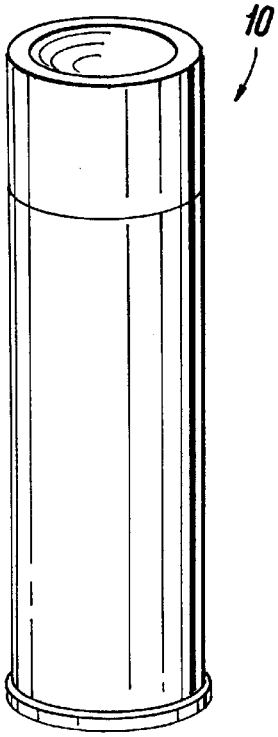
FIG. 1*a* is an isometric view of the bullet with the hollow nose slug.
Figure 1B:
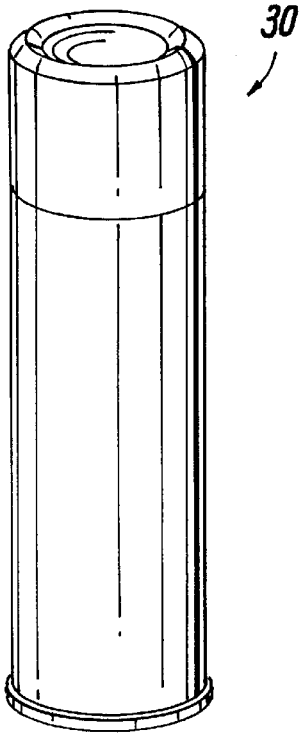
FIG. 1*b* is an isometric view of the radius dimpled projectile body radius hollow tip projectile and cartridge.
Figure 1C:
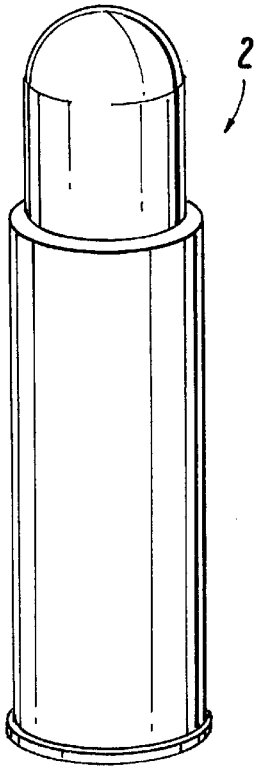
FIG. 1*c* is an isometric view of the round nose slug fitted into the cartridge.
Figure 1D:
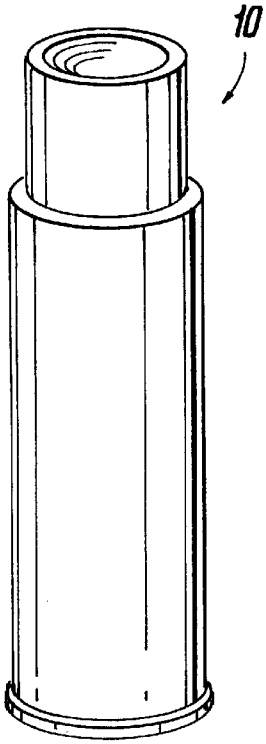
FIG. 1*d* is an isometric view of the dimpled projectile body fitted into the cartridge.
Figure 1E:
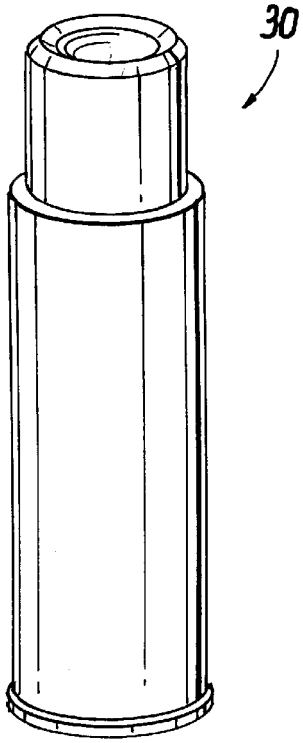
FIG. 1*e* is an isometric view of the radius dimpled projectile body fitted into the cartridge.

With reference to FIG. 1, the preferred embodiment of this invention comprises a cartridge, a projectile and a powder charge with ignition means. Several different projectile forms are disclosed herein sharing a common cartridge and propellant, each of the projectile types will be disclosed.

Figure 2:
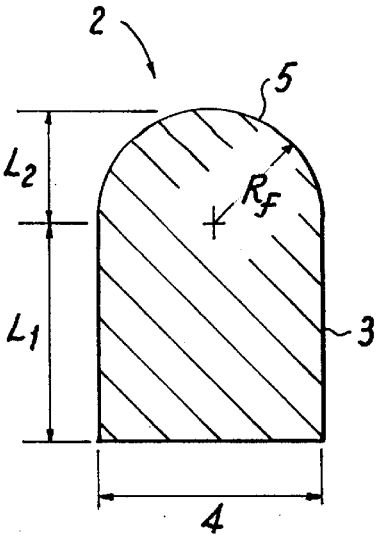
FIG. 2 is cross sectional view of the round nosed projectile body.
Figure 3:
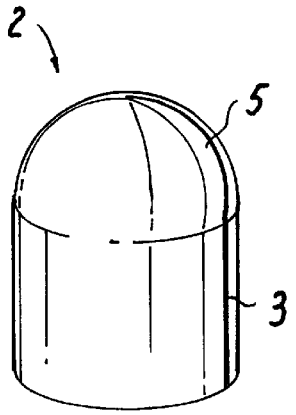
FIG. 3 is an isometric view of the round nosed projectile body.

The round projectile 2 of FIG. 2 and FIG. 3 is made of a relatively soft material such as lead and has a cylindrical portion 3 with a substantially constant diameter which is slightly smaller than the internal diameter 21 of the machined casing 20. The cylindrical portion 3 of the round projectile 2 has a length $L_1$. The tip 5 of the projectile 2 (forms a full radius Rf in tangency with the cylindrical portion 3. The overall projectile 2 length to diameter relationship is $(L_1+Rf)/D=1.25/1$. To be effective the projectile 2 has a minimum diameter (D) of 0.8 inches and an overall height of 1 inch, larger versions retaining this relationship may also be defined.

The casing 20 size is proportioned to have an internal volume capable of propelling the corresponding projectile. The relationship of combustible material to weight of the projectile is ultimately dependent on the quarry. The hunter would choose the load based on the animal hide penetration resistance for a particular class of target animals. A rhinoceros for example, would require one class of bullet of this invention, while a wolf would use a lighter load, but each is sized to stop the target in its tracks.

Figure 4:
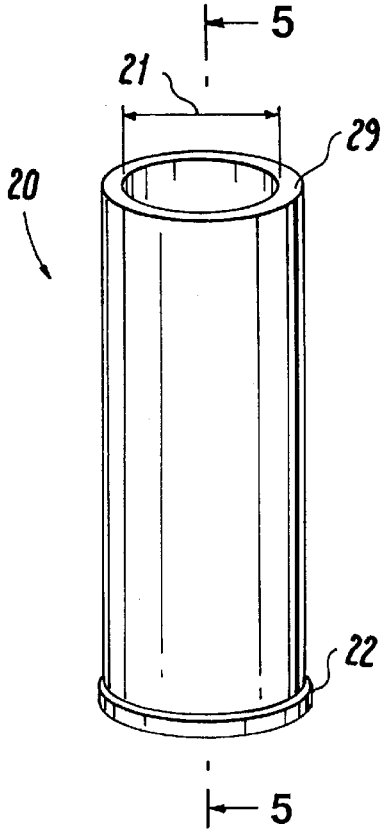
FIG. 4 is an isometric view of the cartridge.
Figure 5:
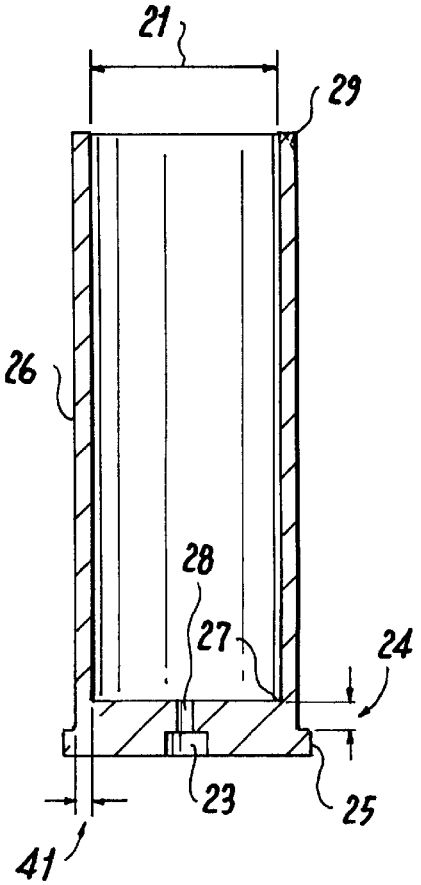
FIG. 5 is a cross section of the preferred embodiment of the cartridge.

The cartridge 20 as shown in FIG. 4 and FIG. 5, has a casing with a chamber having an inner diameter 21 slightly larger than the projectile body cylindrical portion 3. The external surface of the casing is modified at the interface contact 29 area to accommodate a roll crimp to join the projectile body 2 to the cartridge 20.

In a preferred embodiment shown in FIG. 4 and FIG. 5, the cartridge 20 has a large diameter cylindrical casing 26, of constant cross section and is made of solid brass. The ratio of length to width of the casing 26 is between 4.5 to 1 and 5.5 to 1; for example 5 to 1. The thickness 41 of the wall of the casing 26 is at least 0.050 inches and is such that the high forces generated upon ignition of the powder do not deform the casing. The casing is made of one piece construction where the central cavity is generated by the stepwise removal of material from one end of the casing 26 until a predetermined base thickness 24 of at least 0.050 inches remains. The resulting material forms a cylindrical body with a closed end, having a powder capacity between 2.5 and 3.5 cubic inches. The exterior of the casing base 25 is substantially flat. The interior of the casing 26 forms a corner 27 having no internal radius where the wall meets the casing base 25. A primer access aperture 28 is machined into the center of the base 25. In one embodiment the casing base 25 is attached to the rim 22 which is a flat constant cross-sectional plate with a centrally located rim aperture 23. The rim 22 has a diameter approximately 0.10 inch larger than the diameter of the casing 26.

In order to provide the explosive power required to propel the projectile 2 an interdependency exists between the volume of the casing 26, the weight of the projectile 2, the thickness of the casing, and the diameter of the projectile. Those skilled in the art can determine the size of these parameters to meet high load requirements of this design.

Figure 6:
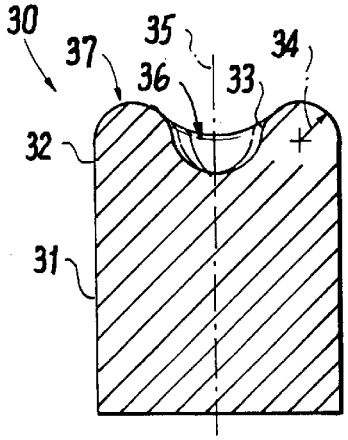
FIG. 6 is a cross section of the preferred embodiment of the radius dimpled projectile body.
Figure 7:
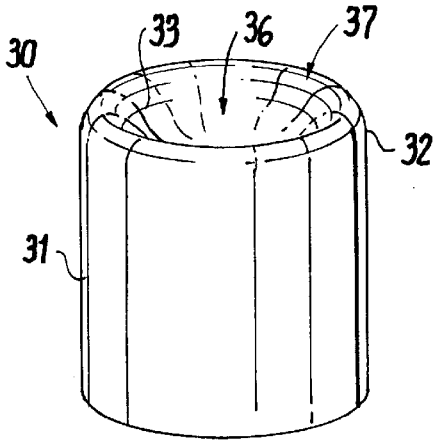
FIG. 7 is an isometric view of the radius dimpled projectile body.

Thus, in another embodiment the cylindrical 31 portion of the projectile 30 is tangentially merged at location 32 to a tip 37 as displayed in FIG. 6 and FIG. 7. A radius dimpled shape or radius half torus shape is generated by sweeping a tip radius 34 having a semicircular arc of a radius smaller than the diameter of the projectile around the axis of the projectile 35 while keeping the tip radius 34 tangent to the exterior surface 31 of the projectile body. The radius half-torus shaped tip 37 is further modified by having a concave section tangent 33 to the tip radius 34 generating a full internal hemispherical surface area 36 as shown in FIG. 6. FIG. 7. depicts an isometric view of the projectile body 30 with this radius dimpled tip 37 configuration. This embodiment may be modified by using an elliptical surface tangentially contacting the inside surface of the tip radius 34. The projectile bodies have diameters in excess of 0.8 inches and the ratio of diameter to height is 1:1.25.

Figure 11:
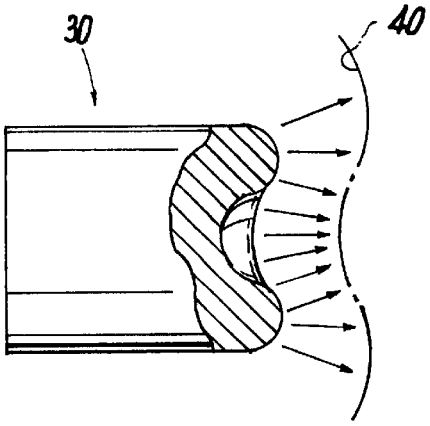
FIG. 11 is a cross section view of the pressure zone formed by the radius dimpled and dimpled projectiles.
Figure 12:
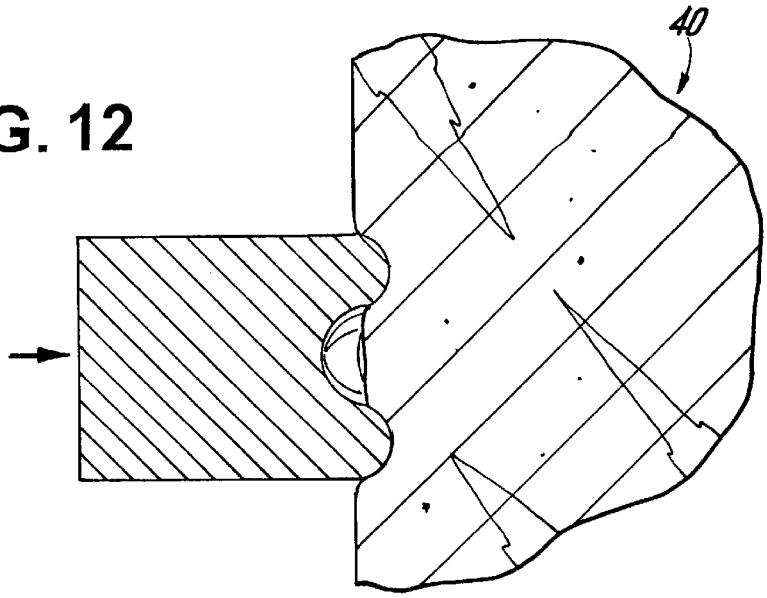
FIG. 12 is a cross section view of the projectile upon initial impact.
Figure 13:
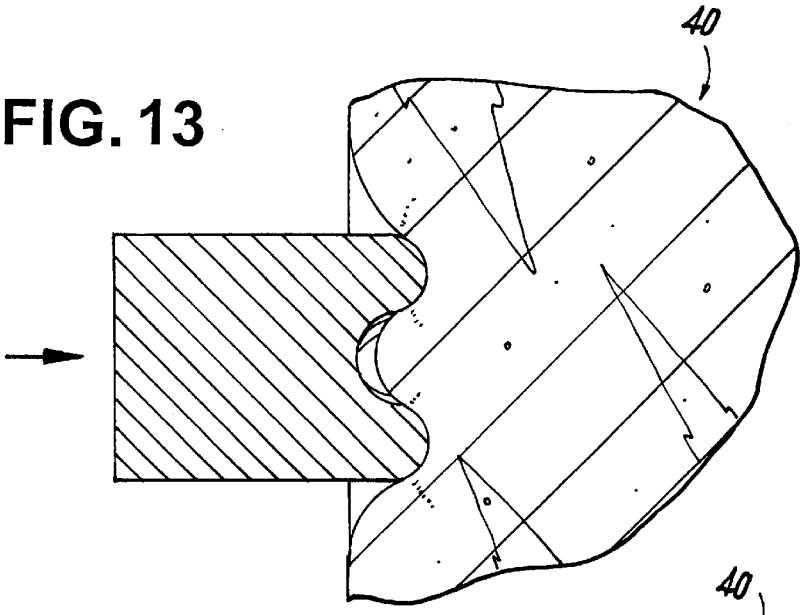
FIG. 13 is a cross sectional view of the projectile some time after initial impact.
Figure 14:
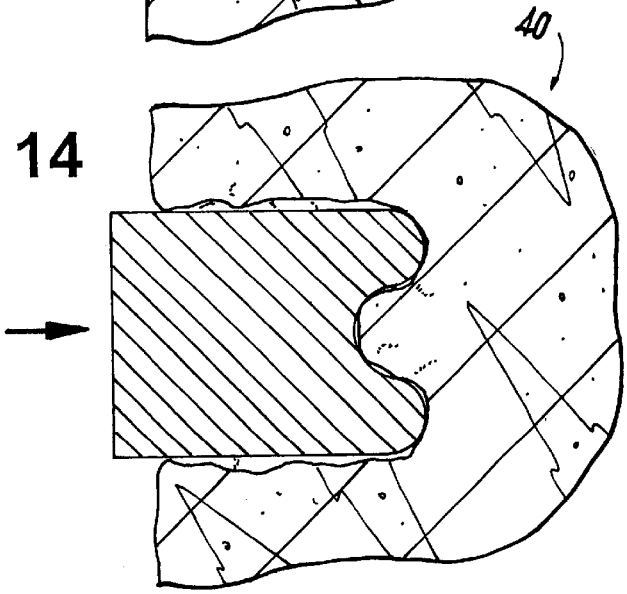
FIG. 14 is a cross sectional view of the projectile following impact after the surrounding tissue tears.

This radius dimpled projectile body 30 with rounded top and dimpled area would initially create a high pressure resistance area 40 (see FIG. 11 and 12) during flight such that increased frictional resistance would be generated whereby the projectile would ultimately be effected by the resistance and thus rapidly decelerate or lose velocity and distance traveled. Upon impact with tissue as shown in FIGS. 12 through 14, the same process would occur except that the increased pressure exerted by the tissue 40 against the projectile would cause the projectile to deform and flatten (depending on the projectile material) as it penetrates, tearing tissue and rapidly transferring energy into the target.

Figure 8:
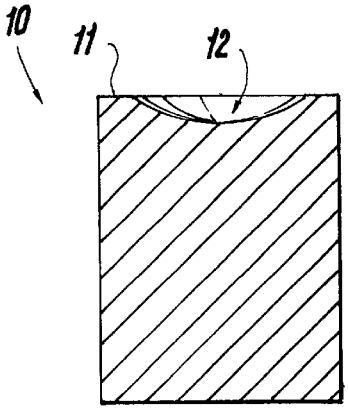
FIG. 8 is a cross section of the preferred embodiment of the flat dimpled projectile body.
Figure 9:
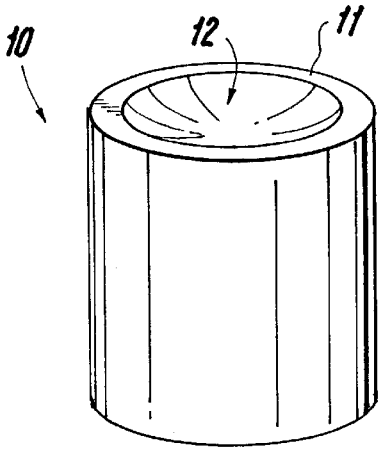
FIG. 9 is an isometric view of the flat dimpled projectile body.
Figure 10:
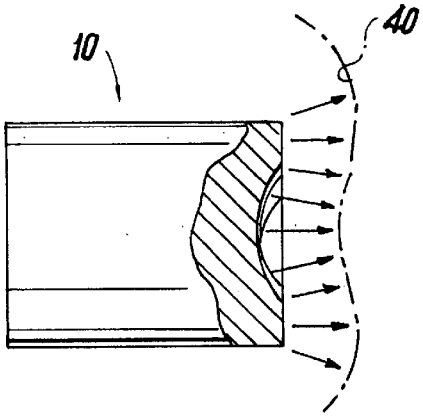
FIG. 10 is a cross section view of the pressure zone formed by the flat dimpled projectile.

Another embodiment of the projectile body 10 (FIG. 8 and FIG. 9) modifies the tip of the projectile to be substantially flat with a centrally located dimple 12 of either radial cross section or elliptical cross section leaving a flat rim 11 area. This embodiment provides flight and impact characteristics similar to the radius dimpled tip 30 and generates an increased pressure area in front of the projectile body (see FIG. 11) which acts to limit the forward progress of the bullet, causing the projectile to tumble beyond the limited striking range of the projectile. The tumbling action would cause increased instability and shorter range.

FIG. 1*a* through 1*e* illustrate how the alternate tip embodiments of this invention may be joined to the casing. A wad may be located between the powder and the projectile base.

I claim:

1. A cartridge comprising:

a) a projectile body having upper and lower portions, wherein the upper portion has a torus-shaped surface facing the path of the projectile body upon firing, the torus-shaped surface having associated outer and inner diameters, and a centrally positioned hemispherical indentation attached to said inner diameter of the torus-shaped surface; and wherein the lower portion has a cylindrical shape with a flat base, the cylindrical shape having a uniform circular projectile cross-section throughout its length, with a length to diameter ratio of the projectile body being between 1 to 1 and 1.25 to 1; and b) a strengthened casing fabricated from a cylindrical block having first and second ends by the steps of:

forming a chamber having a first uniform circular cross-section, by incrementally removing material from the first end of the cylindrical block such that a cylindrical cavity is formed therein with a base thickness of greater than 0.050 inches;

forming an exterior casing wall having a second uniform circular second cross-section with a diameter greater than the diameter of the first cross-section, by removing an exterior thickness of material from an outside portion of the cylindrical block such that a rim is left at the second end; and forming a hole in the second end of the cylindrical block for insertion of a primer therein;

the casing and chamber thereby formed by the casing wall and the second end with the hole therethrough, wherein the thickness of the casing wall exceeds 0.050 inches, the casing length to diameter ratio between 4.5 to 1 and 5.5 to 1;

the cartridge formed by the installation of a propellant in the chamber, the diameter of the lower portion of the projectile body corresponding to the diameter of the chamber, such that when at least the lower portion of the projectile body is located in the chamber, the chamber is closed.

2. The cartridge of claim 1 wherein the projectile body comprises:

a transitional area from a side wall of the lower portion vertically tangent to an exterior portion of the torus shaped surface of the upper portion.

3. The cartridge of claim 2 wherein the diameter of the projectile body is in a range of 0.8 to 1.25 inch.

4. The cartridge of claim 2 wherein lower portion of the projectile body has a diameter less than the diameter of the chamber, with the lower portion beginning below the upper portion and ending at the base of the projectile body.

5. The cartridge of claim 3, wherein the hemispherical indentation forms a radius dimpled shape of the upper portion.

6. The cartridge of claim 1 comprising a propellant charge disposed substantially within the chamber, and an inner wall of the casing formed to contact an outer wall of the projectile body at a distance substantially halfway up the cylindrical lower portion of the projectile body, with the base of the projectile body substantially in contact with the propellant charge, upon ignition of the cartridge, the torus-shaped surface of the upper portion facing the path of the projectile body creating a focused high compression area in front of the projectile body and the flat base of the lower portion creating a significant drag area behind the projectile body such that the high compression area and drag area affect the projectile body to rapidly reduce the velocity of the projectile body, thereby causing the range of the projectile body to be reduced, such that upon impact with a tissue of a target, the high compression area initially deforms and then tears the tissue as the inertia of the projectile body transfers associated kinetic energy to the area of the target surrounding the tissue as the projectile body plastically deforms and weight transfers from a rear section of the lower portion of the projectile body.

7. The cartridge of claim 1 wherein the casing has a tubular cross section having a base with a rim, the rim having a diameter larger than the casing.

8. The cartridge of claim 1 wherein the casing is made of brass.

9. The cartridge of claim 1 wherein the casing has a powder capacity between 2.5 and 3.5 cubic inches.

* * * * *